United States Patent [19]

Eacret

[11] 4,280,641

[45] Jul. 28, 1981

[54] CLOTH SNAG REPAIR TOOL

[75] Inventor: Dan P. Eacret, Spokane, Wash.

[73] Assignee: David P. Roberts, Spokane, Wash. ; a part interest

[21] Appl. No.: 73,998

[22] Filed: Sep. 10, 1979

[51] Int. Cl.[3] ..... D04B 3/00

[52] U.S. Cl. ..... 223/1; 28/141; 66/1 R; 223/102

[58] Field of Search ..... 28/115, 141; 24/155 R; 223/1, 102, 104; 112/222; 139/1.5; 66/1 R, 1 A, 1.5, 2

[56] References Cited

U.S. PATENT DOCUMENTS

| | | | |
|---|---|---|---|
| 1,793,225 | 2/1931 | Dunn et al. . | |
| 3,404,707 | 10/1968 | Feld . | |
| 3,542,632 | 11/1970 | Eickhoff | 28/115 X |
| 3,916,645 | 11/1975 | Hart . | |

FOREIGN PATENT DOCUMENTS

| | | | |
|---|---|---|---|
| 649469 | 10/1962 | Canada | 112/222 |
| 1485382 | 9/1969 | Fed. Rep. of Germany | 112/222 |
| 2750 | of 1890 | United Kingdom | 223/102 |
| 29032 | of 1910 | United Kingdom | 24/155 R |

OTHER PUBLICATIONS

*How to Remove Snags and Pulled Threads From Textured Polyester Double Knit Cloth,* Knitting Times 41(80): p. 45. Mar. 13, 1972.

Torrington Felting Needle Handbook, The Torrington Company, Torrington, Connecticut, 1961, pp. 4–11.

*Primary Examiner*—Robert Mackey

*Attorney, Agent, or Firm*—Wells, St. John & Roberts

[57] ABSTRACT

A cloth snag repair tool is described for removing snags from one side of a cloth. The tool includes a shaft having a length between 60 mm and 90 mm and a maximum diameter between 0.635 mm and 1.65 mm. The shaft has a cloth penetration surface section beginning at a pointed forward end. The cloth penetration surface section has low frictional surface characteristics to enable the shaft to be initially easily inserted into the cloth at a snag location without substantially disturbing the snag. The shaft has a frictional surface section intermediate the cloth penetration surface section and a rear end. The frictional surface section has high surface characteristics to engage and frictionally draw the snag through the cloth as the shaft is forced through the cloth. In a preferred form, the frictional surface section is machine roughened with diamond shaped knurls covering between one third and two thirds the length of the shaft. The tool is particularly effective in repairing snags in clothing, drapes and upholstery.

11 Claims, 8 Drawing Figures

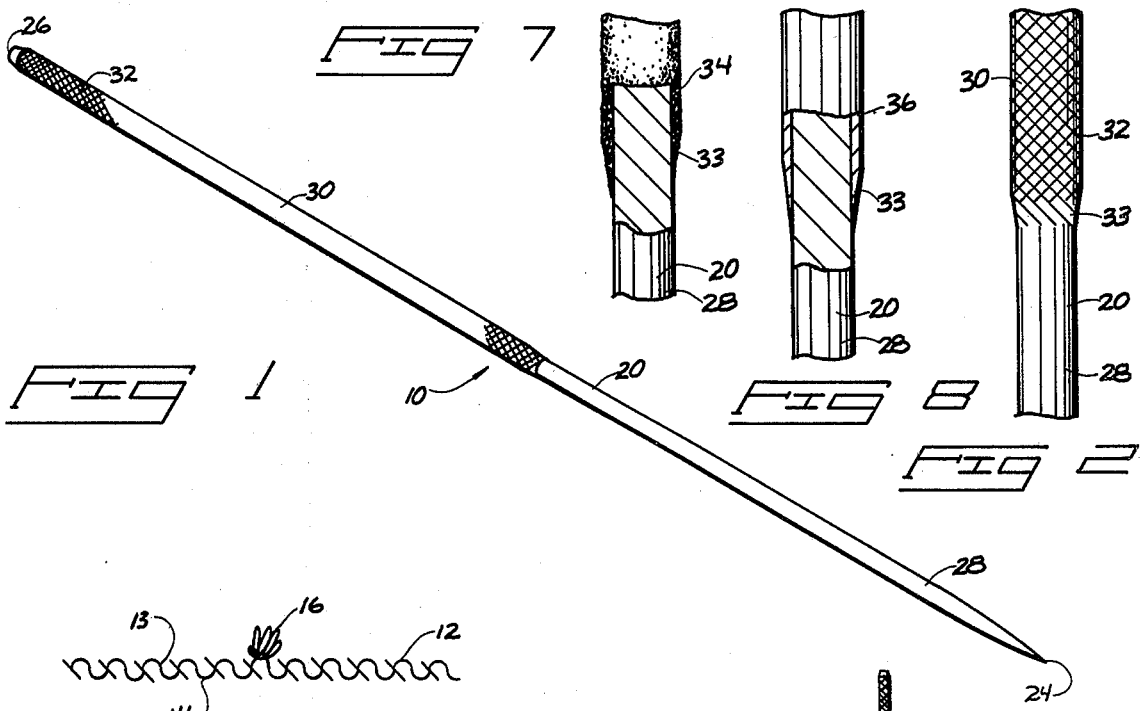
FIG 1
FIG 7
FIG 8
FIG 2
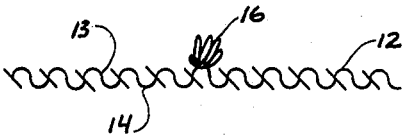
FIG 3
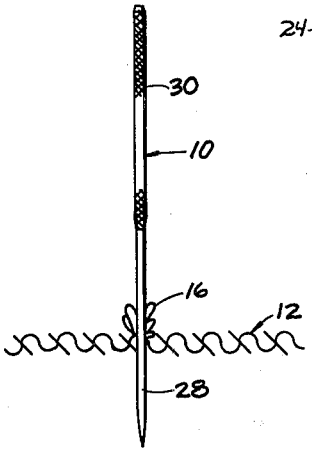
FIG 4
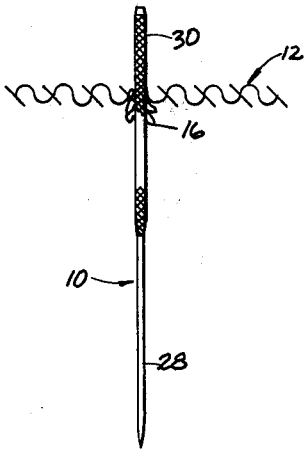
FIG 5
FIG 6
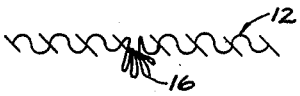

CLOTH SNAG REPAIR TOOL

BACKGROUND OF THE INVENTION

This invention relates to devices for repairing damaged cloth and more particularly to devices for removing snags from cloth items such as garments, curtains and upholstery.

It is a principal object of this invention to provide a very durable, long lasting snap repair tool that is capable of being readily manufactured.

This and other objects and advantages of this invention will become apparent upon reading the following disclosure of a preferred and alternate embodiments.

BRIEF DESCRIPTION OF THE DRAWINGS

Preferred and alternate embodiments of the present invention are illustrated in the accompanying drawings, in which:

FIG. 1 is a pictorial view of a tool of a preferred form of the present invention;

FIG. 2 is an enlarged sectional view of an intermediate portion of the device illustrated in FIG. 1;

FIG. 3 is a diagrammatic view of a cloth in cross section illustrating a snag projecting from one side of the cloth;

FIG. 4 is a diagrammatical view similar to FIG. 3 except showing the device illustrated in FIG. 1 being initially inserted throughthe cloth adjacent the snag;

FIG. 5 is a diagrammatical view similar to FIG. 4 except showing the device being inserted substantially through the fabric frictionally drawing the snag from the one side;

FIG. 6 is a diagrammatical view of the cloth illustrated in FIG. 3 except showing the condition of the cloth after the tool has been inserted therethrough with the snag being removed from the one side;

FIG. 7 is an enlarged fragmentary view of a portion of an alternate form of the invention; and FIG. 8 is an enlarged fragmentary view of a portion of a second alternate form of the invention.

DETAILED DESCRIPTION OF A PREFERRED AND ALTERNATE EMBODIMENTS

The invention as illustrated in the drawings relates to a cloth snag repair tool that is generally designated with the numeral 10. The tool 10 is particularly useful in removing snags from clothing, upholstery and curtains. Other snagged cloth products also may be repaired utilizing such tool. A typical snag 16 is illustrated in FIG. 3 projecting from one side of a cloth 12. The front or right side of the cloth is designated with the numeral 13 and the back or wrong side of the cloth is designated with the numeral 14. For clothing, the front or right side 13 generally projects outward from the wearer whereas the back or wrong side 14 generally projects toward the wearer.

Snags such as that designated with the numeral 16 are comprised of cloth fibers that have been pulled from the normal plane of the cloth and project outward from the side 13. FIGS. 3–6 illustrate the sequence of removing the snag 16 from the right or front side 13 and pulling the snag through the cloth utilizing the subject tool 10.

Broadly, the cloth snag repair tool 10 is formed of an elongated, substantially straight, rigid shaft 20 that extends from a forward extremity 24 to a knobless rear extremity 26. The maximum diameter of the shaft between the extremities is operable between 0.635 mm and 1.65 mm. Preferably, the maximum diameter of the shaft 20, between the extremities, is between 0.81 mm and 1.14 mm. Preferably, the shaft 20 has a circular cross section and has a length of between 60.0 mm and 90.0 mm.

The shaft 20 has a cloth penetrating surface section 28 beginning with the forward extremity 24 and extending rearward therefrom. It is important that the penetrating surface section 28 has low frictional surface characteristics sufficient to enable the penetrating surface section to be easily inserted through the cloth of the snag location without substantially disturbing the snag. Preferably, at least a portion of the cloth penetrating surface section 28 is tapered forming a pointed end with a progressively increasing diameter from the forward extremity 24.

The shaft 20 further has a barbless frictional surface section 30 intermediate the cloth penetrating surface 28 and the rear extremity 26. It is very important that the frictional surface section 30 has a high frictional surface characteristic sufficient to cause the section 30 to frictionally pull or draw the snag 16 through the cloth alongside the section 30 as illustrated in FIG. 5. Additionally, the frictional characteristics of the surface section 30 are such that the section 30 does not tear, sever or break the cloth fibers, either those in the snag or those surrounding the shaft as the shaft is forced through the cloth. A fine balance must be obtained to achieve effective results. Because of the almost infinite varieties of cloth, it is a practical impossibility to determine a value of the coeffecient of friction between the cloth and the surface section 30 as the section 30 passes through the cloth. The effective high frictional surface characteristic may be readily determined through modest experimentation.

A preferred embodiment is illustrated in FIGS. 1 and 2. The frictional section 30 comprises a machine roughened surface 32 extending along a substantial portion of the length of the shaft 20. Applicant has found that excellent results are obtained by machine knurling a substantial porton of the shaft 20 to create a roughened high frictional surface 32. The machine knurled segment extends over more than twenty five percent (25%) of the length of the shaft 20. Preferably, the knurled segment extends between one third and two thirds of the length of the shaft 20. Excellent results have been achieved using a diamond shaped knurling pattern in which the knurling has between 100 and 200 threads per inch with the diameter of the raised areas being less than ten percent (10%) greater than the diameter of the unknurled surface. Preferably, the machine roughened surface 32 has a gradual transition portion 33 with the penetrating surface section 28 in which the diameter and frictional characteristics progressively increase (FIG. 2).

Alternatively, the machine roughened surface 32 is formed by subjecting the section 30 to an abrasive grinding machine capable of greatly increasing the frictional surface characteristics of an otherwise rather smooth surface.

In the preferred embodiment, the shaft 20 is formed of hard metal such as steel. The desired low frictional surface characteristics of the section 28 is preferably obtained by polishing the hard metal shaft. Alternatively, the metal shaft 20 may be plated to obtain the effective low frictional surface characteristics.

In an alternate embodiment, the roughened frictional surface 32 may be formed by metal bonding fine metal particles 34 (FIG. 7) onto an otherwise rather smooth metal surface to create effective high frictional surface characteristics. Such metal bonding may be achieved by vacuum deposition or electrode sputtering. Fine metal particles of tungsten carbide are preferred. Alternatively, metal or other abrasive small particles mounted in a binder may be adhered to the shaft 20 to form the roughened surface 32.

In a further embodiment illustrated in FIG. 8, the frictional surface section 30 has a smooth surface 36 formed of a high frictional characteristic material coated onto the shaft 20. A multitude of formulated rigid plastic or rubber materials may be utilized having effective high frictional surface characteristics. A preferred rigid plastic coating material is vinyl butyral acetate.

During the operation of the tool, the user inserts the cloth penetration section 28 into the right side 13 at the snag location without substantially disturbing the snag as illustrated in FIG. 4. As the tool is forced through the cloth, the frictional surface section 30 engages and frictionally drags or draws the snag through the cloth as illustrated in FIG. 5. FIG. 6 illustrates the cloth with the snag removed from the front or right side 13.

The tool 10 provides for a very effective means of easily removing snags in which the tool has an extremely long, if not indefinite, life. Users of the tool are particularly pleased that a garment snag may be removed while the garment is still being worn.

It should be understood that the above described embodiments are merely illustrative of the principles of this invention and that numerous other embodiments may be readily devised without deviating therefrom.

What is claimed is:

1. A cloth snag repair hand tool for removing a snag of cloth fibers projecting from one side of a cloth at a snag location, comprising:

an elongated, substantially straight, rigid shaft extending from a forward extremity to a knobless rear extremity capable of passing entirely through the cloth at the snag location;

said shaft having a maximum diameter along its length of between 0.635 mm and 1.65 mm;

said shaft having a cloth penetration surface section means beginning at the forward extremity and extending toward the rear extremity in which the cloth penetration surface section has an effectively low frictional surface characteristic for easily inserting the shaft into the cloth at the snag location without substantially disturbing the snag; and said shaft having a barbless frictional surface section means intermediate the cloth penetration surface section means and the rear extremity in which the frictional surface section means has an effectively high frictional surface characteristic for engaging and frictionally drawing the snag from the one cloth side through the cloth without damaging the cloth fibers when the shaft is passed completely through the cloth, entering on the one side at the snag location and exiting from an opposite side of the cloth.

2. The cloth snag repair hand tool as defined in claim 1 wherein the shaft has a maximum diameter of between 0.81 mm and 1.14 mm.

3. The cloth snag repair hand tool as defined in claim 1 wherein the shaft has a length of between 60 mm and 90 mm.

4. The cloth snag repair hand tool as defined in claim 1 wherein the frictional surface section means includes a machine roughened surface.

5. The cloth snag repair hand tool as defined in claim 4 wherein the machine roughened surface is knurled.

6. The cloth snag repair hand tool as defined in claim 5 wherein the machine roughened surface has diamond shaped knurls with between 100 and 200 threads per inch.

7. The cloth snag repair hand tool as defined in claim 1 wherein the frictional surface section means extends along more than twenty five percent of the length of the shaft.

8. The cloth snag repair hand tool as defined in claim 1 wherein the frictional surface section means comprises a layer of fine abrasive particles adhered to the shaft.

9. The cloth snag repair hand tool as defined in claim 1 wherein the frictional section means includes a coating formed on the shaft having an effective high frictional surface characteristic.

10. The cloth snag repair hand tool as defined in claim 9 wherein the coating is formed of vinyl butyral acetate.

11. The cloth snag repair hand tool as defined in claim 1 wherein the cloth penetrating surface section means extends a sufficient distance from the forward extremity to enable a person to grip the cloth penetrating surface section between their fingers on the opposite side of the cloth when the shaft is partially inserted through the cloth and to pull the frictional surface section means entirely through the cloth to draw the snag from the one side of the cloth.

* * * * *